US007314996B2

(12) United States Patent
Nakai et al.

(10) Patent No.: US 7,314,996 B2
(45) Date of Patent: Jan. 1, 2008

(54) COAXIAL CABLE

(75) Inventors: Yoshihiro Nakai, Osaka (JP); Taichiro Nishikawa, Osaka (JP); Yoshiyuki Takaki, Osaka (JP); Kiyonori Yokoi, Kanuma (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 10/580,843

(22) PCT Filed: Aug. 1, 2005

(86) PCT No.: PCT/JP2005/014028

§ 371 (c)(1),
(2), (4) Date: May 26, 2006

(87) PCT Pub. No.: WO2006/022117

PCT Pub. Date: Mar. 2, 2006

(65) Prior Publication Data

US 2007/0079984 A1 Apr. 12, 2007

(30) Foreign Application Priority Data

Aug. 26, 2004 (JP) ..... 2004-247457

(51) Int. Cl.
*H01B 7/00* (2006.01)

(52) U.S. Cl. ..... 174/28; 174/102 R; 174/106

(58) Field of Classification Search ..... 174/28, 174/102 R, 102 A, 106 R, 126.1, 126.2
See application file for complete search history.

(56) References Cited

U.S. PATENT DOCUMENTS 4,161,704 A * 7/1979 Schafer ..... 333/33
4,180,699 A * 12/1979 Hochella ..... 174/126.2
6,068,917 A 5/2000 Tsuno et al.
6,124,551 A * 9/2000 Mattos et al. ..... 174/113 R

FOREIGN PATENT DOCUMENTS

| | | | |
|---|---|---|---|
| JP | 56-106307 A | | 8/1981 |
| JP | 3-46914 | | 4/1991 |
| JP | 6-231902 A | | 8/1994 |
| JP | 7-249315 A | | 9/1995 |
| JP | 9-320343 A | | 12/1997 |
| JP | 11-302817 A | | 11/1999 |
| JP | 2001-23456 A | | 1/2001 |
| JP | 2001-023456 A | * | 1/2001 |
| JP | 3376672 | | 12/2002 |
| JP | 2003-51219 A | | 2/2003 |
| JP | 2003-051219 A | * | 2/2003 |

* cited by examiner

*Primary Examiner*—William H. Mayo, III
(74) *Attorney, Agent, or Firm*—McDermott Will & Emery LLP

(57) ABSTRACT

A coaxial cable including a core conductor, an insulator arranged around the outer periphery of the core conductor, and an outer conductor arranged around the outer periphery of the insulator coaxially relative to the core conductor, where the electrical conductivity is 20% IACS or more and the Young's modulus of the core conductor is 245 GPa or more. In the present invention, the core conductor is preferably made of a material of one or more kinds selected from the group including tungsten, tungsten alloy, molybdenum, and molybdenum alloy.

5 Claims, 2 Drawing Sheets

FIG. 1 -- *PRIOR ART*
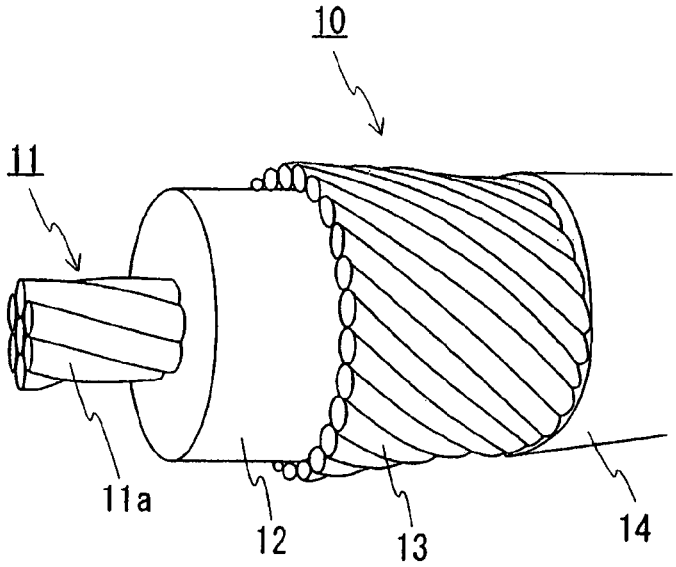
FIG. 2
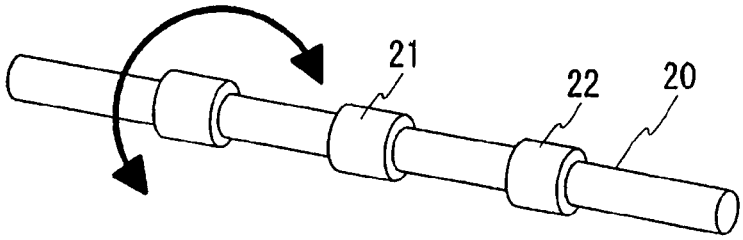

COAXIAL CABLE

RELATED APPLICATIONS

This application is the U.S. National Phase under 35 U.S.C. § 371 of International Application No. PCT/JP2005/014028, filed on Aug. 1, 2005, which in turn claims the benefit of Japanese Application No. 2004-247457, filed on Aug. 26, 2004, the disclosure of which Applications are incorporated by reference herein.

TECHNICAL FIELD

The present invention relates to a coaxial cable having a core conductor, an insulator, and an outer conductor. Particularly, the invention relates to a coaxial cable having superior durability against torsion as well as superior durability against tensile stress and repeated bending.

BACKGROUND ART

In the past, coaxial cables have been widely used as various electric wires and cables: such as a signal transmission cable for an industrial robot or medical equipment such as an endoscope and a diagnostic probe of ultrasonic diagnostic equipment; and a cable for internal connection of information equipment such as a notebook-sized personal computer, and a portable device such as a mobile phone or a PDA. FIG. 1 is a perspective view schematically showing a structure of a coaxial cable. The coaxial cable 10 has a core conductor 11, an insulator 12 arranged at the outer periphery of the core conductor 11, and an outer conductor 13 arranged, at the outer periphery of the insulator 12, coaxially with respect to the core conductor 11, and generally a jacket 14 made of resin, etc. is provided around the outer periphery of the outer conductor 13. In many cases, the coaxial cable used in such an electric equipment as mentioned above is repeatedly subjected to bending in addition to tensile stress during use, which results in accumulation of strain, and in a worst case, a cable may be damaged or broken. Therefore, a coaxial cable widely used has a core conductor 11 made in a stranded wire structure in which a plurality of copper or dilute copper alloy wires 11*a* are stranded together in order to enhance bending resistance. In a patent document 1, in order to improve bending resistance, it is proposed to make a core conductor in a stranded wire structure in which conductor wires are stranded together such that the elastic modulus of a central wire is larger than the elastic modulus of wires in an outer layer. On the other hand, a patent document 2 proposes that a core conductor be made of single solid wire having a specific composition, instead of stranded wires, lest an accident such as short circuit occur due to loosening of the stranded wires.

Patent document 1: Japanese Patent No. 3376672

Patent document 2: Japanese Patent Application Publication No. 2001-23456

DISCLOSURE OF THE INVENTION

Problems to be Solved by the Invention

As mentioned above, a conventional coaxial cable has excellent durability to tensile stress and repeated bending. However, recently, equipment which performs complicated movement including torsion in addition to tensile stress and repeated bending has been developed, and the conventional coaxial cable is insufficient in terms of durability to the torsion, and accordingly the breakage thereof occurs in a rather early stage of use. Therefore, the development of a coaxial cable having superior torsion resistance is demanded.

Therefore, the main object of the present invention is to provide a coaxial cable having superior torsion resistance in addition to superior durability to tensile stress and repeated bending.

Means for Solving the Problems to be Solved

As a result of examining the relationship between the characteristics of a material of a core conductor and the durability of the core conductor until it is broken in the case where the core conductor is subjected to three kinds of movement including tensile stress, repeated bending, and torsion, the present inventors found that there is correlation between the elastic modulus (Young's modulus) of the core conductor and the performance of the above-mentioned three kinds of movement. That is, it was found that in the case of a coaxial cable having a core conductor of a specific Young's modulus, the durability until it is broken is improved significantly as compared with a conventional coaxial cable even if the three modes of movement including tension, bending, and torsion are applied thereto. Therefore, the present invention achieves the above-mentioned object by defining Young's modulus of a core conductor in particular.

That is, the present invention relates to a coaxial cable comprising a core conductor, an insulator arranged around the outer periphery of the core conductor, and an outer conductor arranged around the outer periphery of the insulator coaxially relative to the core conductor. The Young's modulus of the core conductor is 245 GPa or more, and the electrical conductivity is 20% IACS or more.

Hereinafter, the present invention is described in detail.

The coaxial cable of the invention is provided with a core conductor, an insulator, and an outer conductor in the enumerated order from the center. In addition, the coaxial cable may be equipped with a jacket around the outer periphery of the outer conductor. Also, the coaxial cable of the invention may be a single-core cable having one core that is composed of a core conductor, an insulator, and an outer conductor, or a multicore cable comprising a plurality of such cores assembled together and a common jacket covering the outer periphery of the assembled cores jacket altogether. Moreover, the coaxial cable of the invention may be a multicore cable having a structure in which a plurality of cores each composed of a core conductor, an insulator, an outer conductor, and a jacket are assembled together, and in which the assembled cores is provided with a common jacket covering the outer periphery of the assembled cores altogether.

And, the core conductor is designed to have a Young's modulus of 245 GPa or more. The reason for that is because with less than 245 GPa, improvement in the durability available until a cable (particularly the core conductor) is broken is insignificant when the core conductor is repeatedly subjected to the compound movement of tensile stress, bending, and torsion. Particularly preferable Young's modulus is equal to or more than 280 GPa. Also, in the present invention, the electrical conductivity of the core conductor is preferably 20% IACS or more. The reason for this is because with less than 20% IACS, the electrical conductivity is so low that Joule heat occurs inside the core conductor, which results in increase of transmission loss in the case of transmitting a signal. Particularly, 25% IACS or more is preferable.

In the present invention, a core conductor is formed of a material having both of the above-mentioned Young's modulus and electrical conductivity. For example, the material of the core conductor may be a metal, particularly, one or more kinds of metal selected from the group consisting of tungsten, molybdenum, tungsten alloy, and molybdenum alloy. The term "tungsten" as used herein means so-called pure tungsten consisting of tungsten and inevitable impurities, and the term "molybdenum" as used herein means so-called pure molybdenum consisting of molybdenum and inevitable impurities. Tungsten alloy is, for example, an alloy containing Cu, Al, Si, K, Re, $ThO_2$, or $CeO_2$ with the balance consisting of tungsten and inevitable impurities. Molybdenum alloy is, for example, an alloy containing Cu, Co, Sn, Al, Si, or K with the balance consisting of molybdenum and inevitable impurities.

The core conductor made of the above-mentioned materials may be formed in either a single solid-wire structure or a stranded-wire structure made by stranding a plurality of wires. The core conductor made of a single solid wire is advantageous in that (1) in the case of the same cross-sectional area (nominal cross-sectional area) of conductor, miniaturization can be made further in a single-solid wire structure than in a stranded-wire structure; (2) in soldering a core conductor to a circuit board with a narrow pitch pattern, the single-solid wire structure does not cause a short circuit as in the case of the stranded-wire structure that suffers from the loosening of stranding; and (3) nonexistence of a wire-stranding process allows the reduction of substantial manufacturing cost. Also, even in the case of core conductor having a solid single wire structure, if Young's modulus of 245 GPa or more is satisfied, particularly the torsion resistance thereof is superior as compared with that of a conventional core conductor made of stranded copper or copper-alloy wires. When a core conductor is made by stranding wires according to the present invention, the wires may be formed from the same material or different kinds of materials. For example, the core conductor may be made by stranding wires consisting of pure tungsten and wires consisting of tungsten alloy altogether. In this case, the Young's modulus and the electrical conductivity as defined in the present invention should be satisfied. For example, the composition of each wire may be adjusted.

Particularly, when a core conductor is made of a single solid wire, the outer diameter of the wire may be 0.01 mm or more and not more than 0.2 mm. When bending and torsion are applied to the core conductor, assuming that the pitch of torsion and the bending radius are the same in the case of bending, the larger the outer diameter of the core conductor, the more the quantity of strain that occurs in the core conductor surface, which tends to cause breakage thereof at an early stage. Therefore, preferably the outer diameter of the core conductor is 0.2 mm (200 μm) or less lest the durability prior to breakage be reduced when two modes of bending and torsion motions are applied to the core conductor. Particularly, 0.1 mm (100 μm) or less is preferable. Thus, in the case of bending and torsion only being applied, the smaller the outer diameter of the core conductor, the better. On the other hand, when tensile stress is applied in addition to bending and torsion, if the outer diameter of the core conductor is reduced too much, particularly in the case of the outer diameter being reduced to 0.01 mm (10 μm) or less, the durability prior to the breakage thereof extremely decreases. Therefore, preferably the core conductor made of a single solid wire should have the outer diameter of 0.01 mm or more. In the case where a core conductor is formed by stranding a plurality of wires, preferably the outer diameter of each wire is 0.004 mm or more and not more than 0.06 mm, and the outer diameter of the core conductor made of the stranded wires is preferably 0.1 mm or more and not more than 0.2 mm as in the case of single solid wire.

Moreover, the core conductor may have a tensile strength of 2450 MPa or more. It was found that if the tensile strength is high, the core conductor is superior in terms of torsion resistance in addition to bending resistance. More specifically, it was found that if the tensile strength is equal to or more than 2450 MPa, the durability prior to breakage of a core conductor can be improved more in the compound mode of tension, bending and torsion. The tensile strength can be adjusted depending on the material of the core conductor and the wire-drawing conditions. The wire-drawing conditions may be adjusted according to the material for forming the core conductor. Generally, the tension strength tends to increase as the number of wire-drawing times increases. Also, when tungsten or the alloy thereof is used as the forming material, it is easy to obtain a tensile strength of 2450 MPa or more.

Besides, a plated layer may be provided on the surface of the core conductor. By providing the plated layer, the core conductor can be improved with respect to connectibility with other members. More specifically, when the core conductor and the other members are bonded by soldering, the solder wettability can be improved by providing a plated layer on the core conductor, whereby the connectibility can be improved. Also, in the case where a terminal is connected with the core conductor by crimping, the degradation of the splice reliability due to the oxidation of the core conductor or the like can be prevented by providing a plated layer on the core conductor. Therefore, it is possible to improve the splice reliability by using a core conductor having a plated layer, even in the case of a circuit board with a narrow pitch pattern, in a situation where there is strong demand for adopting a miniaturized cable, particularly a miniaturized core conductor, in compliance with the recent increase of signal transmission quantity, for example.

The material for forming such a plated layer may be a metal made of one or more kinds selected from the group consisting of Cu, Ni, Sn, Au, Ag, Pd, and Zn. It may be one kind of metal element or an alloy plating consisting of one or more kinds of metal elements as selected from the above-mentioned group. Particularly, Ni, Au, Sn, and Ag are preferable. Also, the suitable thickness of the plated layer is equal to or less than 5 μm. This is because the mechanical characteristics, bending resistance, and torsion resistance characteristics deteriorate if the plating exceeding 5 μm is provided. Particularly, the preferable thickness is 0.05-2.0 μm. In the case of a core conductor formed by stranding a plurality of wires, each of the wires to be used therein may be provided with a plated layer.

The above-mentioned core conductor is equipped with an insulator (dielectric) at the outer periphery thereof. As for the material of the insulator, it is preferable to use a material having flexibility in addition to insulation property. For example, the following are suitable for such material: resins such as an epoxy resin, polyester type resin, polyurethane type resin, polyvinyl alcohol type resin, vinyl chloride type resin, vinyl ester type resin, acrylic type resin, epoxy acrylate type resin, diallyl phthalate type resin, phenol type resin, polyamide type resin, polyimide type resin, and melamine type resin; polyethylene, polyethylene terephthalate, and polypropylene; organic fibers made of these resins, and inorganic fibers made of inorganic matter. These materials may be used either in singularity or in combination of plural kinds thereof. Particularly, a fluorocarbon type resin having low dielectric constant and capable of being processed by thinner extrusion is suitable. Materials used in a conventional coaxial cable may be used. Such insulator can be formed around a core conductor by extrusion. More specifically, the extrusion may be performed such that the core conductor is arranged in a mold having a tubular hollow region and the above-mentioned resin material is extruded into the mold.

The outer conductor is provided around the outer periphery of the above-mentioned insulator. The outer conductor may be formed using the same materials as used in outer conductors of conventional small-diameter coaxial cables generally used in medical equipment, information equipment, or a portable device. The outer conductors of such small-diameter coaxial cables are generally made to have flexibility. Such outer conductor may be formed, for example, by lapping a small-diameter wire or a thin-thickness and small-width tape-shaped wire, which is made of a conductive material such as copper or copper-alloy, around the outer periphery of the above-mentioned insulator, or by arranging a braided material made of small-diameter conductors or small-diameter wires made by stranding extremely small-diameter conductors (e.g., litz wire) around the outer periphery of the above-mentioned insulator. Also, these tape-shaped wires, small-diameter wires, and extremely small-diameter wires may have a plated layer around the outer periphery thereof. The plated layer is preferably made of one or more kinds of metals selected from the group consisting of Cu, Ni, Sn, Au, Ag, Pd, and Zn.

A jacket may be provided around the outer periphery of the outer conductor. The material of the jacket may be selected appropriately out of materials generally used as jacketing materials of coaxial cables. For example, the jacket may be made, using a thermoplastic material made of a resin selected out of the above-mentioned resins used as materials of an insulator or other thermoplastic materials, and by heat adhesion after covering the outer periphery of the outer conductor with the thermoplastic material, or by extrusion molding in the same manner as in the case of forming an insulator.

Advantageous Effect of the Invention

As described above, the coaxial cable of the present invention is advantageous in that it exhibits superior durability with respect to torsion in addition to the durability to tensile stress and repeated bending. Thus, the time available for use until the core conductor is broken can be extended, and accordingly the lifetime of the cable can be extended substantially.

BRIEF DESCRIPTION OF THE DRAWINGS

FIG. 1 is a perspective view showing the outline of composition of a coaxial cable.

FIG. 2 is a schematic diagram illustrating a method of torsion test.

EXPLANATION OF REFERENCED NUMERALS

Figure 3:
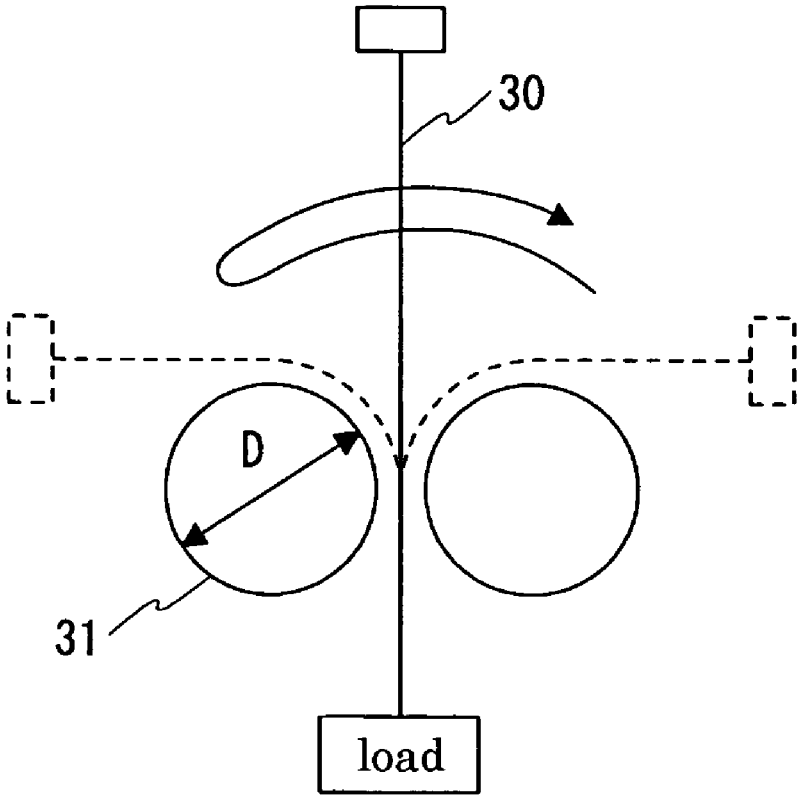
FIG. 3 is a schematic diagram illustrating a method of bending test.

10: coaxial cable, 11: core conductor, 11*a*: wire, 12: insulator,13: outer conductor, 14: jacket, 20 and 30: cable subjected to test, 21 and 22: clamp, 31: mandrel rod

BEST MODE FOR CARRYING OUT THE INVENTION

Hereinafter, preferred embodiments of the invention is described. The dimensional ratio of the accompanying drawings does not always represent that of the description.

TEST EXAMPLE 1

A single-core coaxial cable was made from the materials shown in Table I, and a torsion test and a bending test were performed. The coaxial cables used in the test were prepared in the following manner.

<Production of Coaxial Cables>

The tungsten wires and molybdenum wires having diameters shown in table I were prepared by forming and sintering the respective powders into ingots and by subjecting the ingots to hot-swaging and wire-drawing processing. Also, the Cu-0.3% Sn alloy wires having a diameter shown in Table I were prepared by cold-drawing a wire rod of 8.0 mm prepared by a continuous casting and rolling method. The conditions for the forming and sintering of the tungsten and molybdenum powders, hot-swaging, and hot-wire drawing, and the conditions for the continuous casting and rolling and the wire-drawing condition of the Cu-0.3% Sn alloy wires were the conditions generally adopted for preparing wires having small diameters as shown in Table I. Two kinds of core conductors, that is, a core conductor made of one wire (single solid wire) and a core conductor made by stranding plurality of wires were prepared. The wires of sample Nos. 3 and 100 were plated on the outer periphery of the wires, and the wires having a plated layer were used for core conductors. The core conductors thus obtained were provided with a dielectric (insulator) at the outer periphery thereof. In this example, the dielectric was formed by extruding a fluorocarbon resin onto the outer periphery of a core conductor.

An outer conductor (shield) was formed by braiding Sn-plated thin metal wires (Cu-0.3 mass % Sn) around the outer periphery of the dielectric. Moreover, a jacket was formed by extruding a fluorocarbon resin onto the outer periphery of the outer conductor. Thus, a single-core coaxial cable consisting of a core conductor, an insulator, an outer conductor, and a jacket, which were arranged in the enumerated order from the center was prepared. A plurality of such coaxial cables were prepared for every kind of sample having a different core conductor. In Table I, "tungsten" is pure tungsten consisting of W and inevitable impurities, and "molybdenum" is a pure molybdenum consisting of Mo and inevitable impurities. Also, the thickness of a jacket is adjusted so that the outer diameter of a cable becomes 0.19 mm.

TABLE I

| | | Sample No. | | | | | |
|---|---|---|---|---|---|---|---|
| | | 1 | 2 | 3 | 4 | 100 | 101 |
| Core conductor | Material | Tungsten | Tungsten | Tungsten | Molybdenum | Cu—0.3%Sn | Cu—0.3%Sn/6 wires tungsten/1 wire |
| | Structure | 1 wire | 7 wires | 1 wire | 7 wires | 7 wires | |
| | Wire dia. | 40 μm | 16 μm | 30 μm | 16 μm | 16 μm | 16 μm |
| | Plating thickness | Nil | Nil | Ag 0.1 μm | Nil | Ag 0.1 μm | Nil |
| Dielectric | Material | Fluorocarbon resin | | | | | |
| | Thickness | 0.035 mm (35 μm) | | | | | |
| Shield | Material | Sn plating Cu—0.3%Sn | | | | | |
| | Wire dia. | 20 μm | | | | | |
| Jacket | Material | Fluorocarbon resin | | | | | |
| | Outer dia. | 0.19 mm | | | | | |

The coaxial cables thus prepared were subjected to a torsion test. In the torsion test, a central portion of a test cable 20 was fixed with a clamp 21, while the end side of the test cable was held with a clamp 22 as shown in FIG. 2. The test cable 20 was twisted with the clamp 22 under the conditions in which the distance between the clamp 21 and the clamp 22 (holding length) was 10 mm, the torsion angle (twisting angle) was ±180°, and the torsion speed was 60 times per minute. Thus, the number of twisting times was measured until the core conductor was broken (the number of twisting times is determined counting as one when a twisting of 180° in one direction and another twisting of 180° in the opposite direction are accomplished). In the present test, the average of n=3 was sought. The results are shown in Table 2.

Also, a bending test was performed with respect to another coaxial cable. The bending test was conducted in a left-right bending method. More specifically, as shown in FIG. 3, in a state where a central portion of a test cable 30 was held with metallic mandrels 31 having a circular cross-section (the mandrel's outer diameter D: 10 mm) while a load (10 g) was attached to one end of the cable 30, the other end side of the cable 30 (a portion on the side where the load was not attached, i.e., the upper end side in FIG. 3) was bent by 90° each in left and right directions along the outer periphery of the mandrels 31. Thus, the number of bending times was measured until the core conductor was broken, in a manner in which a bending of 90° in either direction was counted as one (in FIG. 3, the number of bending times is counted as two in the case where after bending in a right direction, a bending in a left direction via the perpendicular direction is completed and then a bending in the right direction via the perpendicular direction is completed). In the present test, the average of n=3 was sought. The results are shown in Table II.

Moreover, Young's modulus (GPa), electrical conductivity (% IACS), and tensile strength (MPa) were measured with respect to the core conductors of the above-mentioned samples Nos. 1-4, 100, and 101. The core conductors used for these measurements were not those assembled in the coaxial cables but those prepared beforehand as core conductors prior to use in coaxial cables. The result are shown in Table II.

TABLE II

| | | Sample No. | | | | | |
|---|---|---|---|---|---|---|---|
| | | 1 | 2 | 3 | 4 | 100 | 101 |
| Core conductor | Young's modulus | 402 Gpa | 402 Gpa | 402 Gpa | 327 Gpa | 118 Gpa | 147 Gpa |
| | Electrical conductivity | 28% IACS | 28% IACS | 28% IACS | 26% IACS | 70% IACS | 62% IACS |
| | Tensile strength | 3038 Mpa | 3330 Mpa | 3135 Mpa | 1940 Mpa | 882 Mpa | 1047 Mpa |
| Torsion test (times) | | 176825 | 413119 | 237642 | 169157 | 28649 | 59194 |
| Bending test (times) | | 213987 | 347564 | 251932 | 178911 | 31946 | 60832 |

As shown in Table II, sample Nos. 1-4, which have high Young's modulus, i.e., more specifically 245 GPa or more, particularly more than 300 GPa, are superior in torsion resistance as well as in tensile strength and bending resistance. Also, as shown in Table II, they satisfy an electrical conductivity of 20% IACS or more and can be used satisfactorily as cables for signal transmission. Therefore, it was confirmed that the cables of the present invention are suitable for use as a coaxial cable used in a place where torsion is applied in addition to tensile stress and repeated bending.

Also, sample No. 2, in which the core conductor has a stranded wire structure, is superior in the bending resistance and torsion resistance as compared with sample No. 1. Likewise, sample No. 3, which has a smaller wire diameter as compared with sample No. 1, is superior to sample No. 1 in terms of the bending resistance and torsion resistance. Moreover, sample No. 1 is superior to sample No. 100 (equivalent to a conventional article), which has a core conductor of stranded wire structure consisting of copper alloy wires, with respect to both of the bending resistance and the torsion resistance. In addition, sample No. 1 is superior in terms of both of the bending resistance and the torsion resistance, as compared to sample No. 101, which has a core conductor having a structure (a central wire: tungsten; wires in an outer layer: copper alloy) as described in the patent document 1.

TEST EXAMPLE 2

A coaxial cable in which the material of the core conductor was different from that of the coaxial cable made for the test example 1 was prepared and subjected to a torsion test and a bending test in the same manner as described above. The following three kinds of core conductors were prepared:

Sample No. 5: a single solid wire consisting of tungsten alloy (composition: 10 mass % of Cu; balance: W and inevitable impurities) (wire diameter: 40 μm)

Sample No. 6: a single solid wire consisting of molybdenum alloy (composition: 10 mass % of Cu; balance: Mo and inevitable impurities) (wire diameter: 30 μm)

Sample No. 7: stranded wires, with a molybdenum wire being arranged at the center (wire diameter: 16 μm) and six tungsten wires being arranged in an outer layer (wire diameter: 16 μm).

It was confirmed that the samples Nos. 5-7 were superior in torsion resistance as well as in the tensile strength and the bending resistance as in the above-mentioned samples Nos. 1-4. The samples Nos. 5-7 exhibited Young's modulus of 280 GPa or more, an electrical conductivity of 20% IACS or more, and a tensile strength 1800 MPa or more, and particularly, the core conductor consisting of tungsten alloy exhibited a tensile strength of 2500 MPa or more.

TEST EXAMPLE 3

Coaxial cables were prepared in which only a plated layer of a core conductor was different from the plated layer of sample No. 3 used in the test example 1, and a torsion test and a bending test were performed in the same manner as described above. The core conductors were prepared with the following seven kinds of plating. The thickness of each plated layer was selected in the range of 0.1-1 μm.

Sample No. 3-1: Cu-plated layer
Sample No. 3-2: Ni-plated layer
Sample No. 3-3: Sn-plated layer
Sample No. 3-4: Au-plated layer
Sample No. 3-5: Pd-plated layer
Sample No. 3-6: Zn-plated layer
Sample No. 3-7: Sn-Ag-plated layer It was confirmed that the samples Nos. 3-1 through 3-7 were also superior in the tensile strength, the bending resistance, and the torsion resistance as the above-mentioned sample No. 3. The samples Nos. 3-1 through 3-7 exhibited Young's modulus, electrical conductivity, and tensile strength which were similar to those of the sample 3.

TEST EXAMPLE 4

Sixty pieces of the same coaxial cables (cores) were prepared for each of sample Nos. 1 to 7, 3-1 to 3-7, 100, and 101, which were prepared in the test examples 1 through 3. Then, coaxial cables having a plurality of these cores were produced and subjected to a torsion test and a bending test as in the test examples 1 through 3. More specifically, 60 cores were lapped altogether with a plastic tape made of fluorocarbon resin, etc. such that a multicore coaxial cable having a circular cross-section (cable outer diameter: 2.0 mm) was prepared for each of sample Nos. 1 to 7, 3-1 to 3-7, 100, and 101. It was found that the multicore coaxial cables having a core conductor of Young's modulus 245 GPa or more were superior in the tensile strength, the bending resistance, and the torsion resistance. Therefore, it was confirmed that the present invention enables the above-mentioned superior effect not only in a single-core coaxial cable but also in a multicore coaxial cable.

INDUSTRIAL APPLICABILITY

A coaxial cable of the present invention is suitable for use as a signal transmission cable for an industrial robot or medical equipment such as an endoscope and a diagnostic probe of ultrasonic diagnostic equipment, or a cable for internal connection of information equipment such as a notebook-sized personal computer, and a portable device such as a mobile phone or a PDA. Particularly, the cables of the present invention exhibit superior durability when used in a place where torsion is applied in addition to tensile stress and repeated bending.

The invention claimed is:

1. A coaxial cable comprising a core conductor, an insulator arranged around the outer periphery of the core conductor, and an outer conductor arranged around the outer periphery of the insulator coaxially relative to the core conductor, wherein the Young's modulus of the core conductor is 245 GPa or more and the electrical conductivity is 20% IACS or more.

2. A coaxial cable as defined in claim 1, wherein the core conductor is made of a single solid wire having an outer diameter of 0.01 mm or more and not more than 0.2 mm.

3. A coaxial cable as defined in claim 1, wherein the core conductor has a tensile strength of 2450 MPa or more.

4. A coaxial cable as defined in claim 1, wherein the core conductor has a plated layer on the surface thereof, the plated layer comprising one or more kinds of metallic materials selected from the group consisting of Cu, Ni, Sn, Au, Ag, Pd, and Zn, the thickness of the plated layer being 5 μm or less.

5. A coaxial cable as defined in claim 1, wherein the core conductor is made of one or more kinds of metals selected from the group consisting of tungsten, molybdenum, tungsten alloy, and molybdenum alloy.

* * * * *